United States Patent [19]

Engmann et al.

[11] 4,098,467

[45] Jul. 4, 1978

[54] APPARATUS FOR WINDING FILAMENTARY MATERIAL

[75] Inventors: Gunther Engmann, Schwabach; Karl Jorg, Georgensgmund; Hermann Heider, Kammerstein nr. 76, all of Fed. Rep. of Germany

[73] Assignee: Maschinenfabrik Niehoff, KG, Schwabach, Fed. Rep. of Germany

[21] Appl. No.: 767,309

[22] Filed: Feb. 10, 1977

[30] Foreign Application Priority Data

Mar. 12, 1976 [DE] Fed. Rep. of Germany ..... 2610393

[51] Int. Cl.[2] ..... B65H 54/00; B65H 67/04

[52] U.S. Cl. ..... 242/25 A

[58] Field of Search ..... 242/25 A, 25 R, 18 A, 242/18 R, 18 PW

[56] References Cited

U.S. PATENT DOCUMENTS

| | | | |
|---|---|---|---|
| 3,347,477 | 10/1967 | Touze | 242/25 A |
| 3,441,229 | 4/1969 | Henrich | 242/25 A |
| 3,596,844 | 8/1971 | Engmann | 242/25 A |
| 3,620,482 | 11/1971 | Bravin | 242/25 A |
| 3,695,527 | 10/1972 | Kobayashi et al. | 242/25 A |

FOREIGN PATENT DOCUMENTS

| | | | |
|---|---|---|---|
| 2,323,747 | 11/1974 | Fed. Rep. of Germany | 242/25 A |

*Primary Examiner*—Stanley N. Gilreath

[57] ABSTRACT

Filamentary material is continuously wound on a pair of rotating spools, provided with feed means for excursively drawing the material to the spools and a transfer device for changing the feed of the material from one spool to the other. The transfer device is moved from association with the spool around which the material is being first wound to the spool around which the material is to be next wound in advance of the actual changeover of feed of said material from one spool to the other.

11 Claims, 5 Drawing Figures

APPARATUS FOR WINDING FILAMENTARY MATERIAL

BACKGROUND OF THE INVENTION

The present invention relates to apparatus for continuously winding filamentary material such as wire on to rotating spools and in particular to apparatus in which the winding of said material can be automatically transferred from one take up spool to another.

The known apparatus for winding wire-like material is exemplified in German patent publication No. 1574357 corresponding to U.S. Pat. No. 3,441,229 and German patent publication No. 1774266 corresponding to U.S. Pat. No. 3,596,844 wherein a pair of take up spools are arranged, each coaxially with an auxiallary spool and a loop forming excursion device. These arrangements are firstly quite complicated structurally and secondly difficult to operate and not completely safe, particularly when there is a jamming of the wire necessitating the cleaning of the catcher blade. In addition, since the respective take up and auxillary spools are mounted on the same cantilevered rotating shaft, the increase in size of the take up spool, normally at the free end of the shaft so that it can be removed, changes the center of gravity relative to the shaft bearing so that it is not possible to wind large and heavy spools at high speeds of rotation.

It is an object of the present invention to provide winding apparatus which is simpler in design and structure then the prior devices.

It is a further object of the present invention to provide a winding apparatus which is easy to operate, requires little maintenance and which is economical to build and to use.

It is another object of the present invention to provide winding apparatus for extremely thin wire making it possible to wind wire of indefinite substantially endless length, of any chosen length, even where the length is obtained by welding successive pieces end to end.

These objects as well as other objects and advantages of the present invention will be obvious from the following disclosure.

SUMMARY OF THE INVENTION

According to the present invention, there is provided apparatus for continuously winding filamentary material comprising a pair of rotating spools, feed means for excursively drawing the material to the spools and a transfer device for changing the feed of the material from one spool to the other, including means to move the transfer device from assotiation with the spool around which the material is being first wound to the spool around which the material is to be next wound in advance of the actual changeover of feed of said material from one spool to the other.

In particular, the winding apparatus comprises a pair of take up spools each arranged to rotate about axially parallel fixed shafts and the feed means comprises at least one pair of wire guide pulleys rotatable about axes parallel to the shafts capable of excursion across the spool and reciprocably movable into association with one or the other of the take up spools. The transfer device comprises a single mechanism adapted to move (in one embodiment to swing pendulum like and in another embodiment to traverse linearly) between the take up spools substantially parallel to the plane of the spool axes.

Preferably, the take up spools are mounted on their shafts as close as possible to the supporting wall of the housing in which the bearings are located since, in accordance with the present invention, it is then possible to mount both the feed means and the transfer means free of the shafts and on the withdrawal side of the shafts.

Full details of the present invention are set forth in the following disclosure, and are shown in the accompanying drawings.

DESCRIPTION OF THE INVENTION

Figure 2:
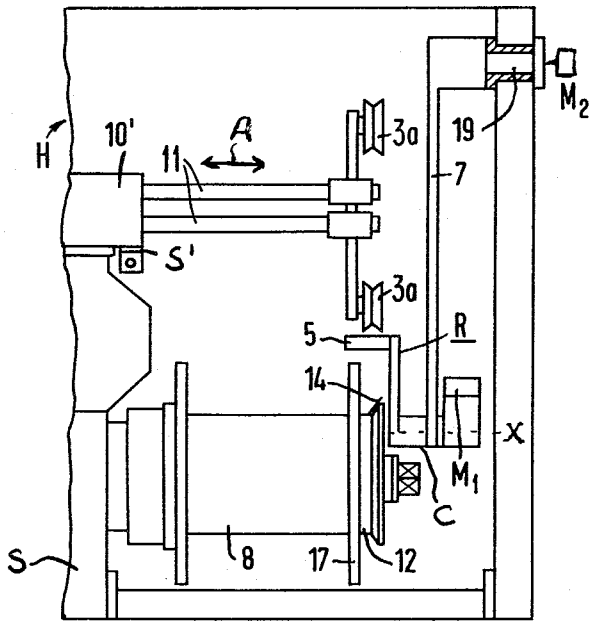
FIG. 2 is a side view of the apparatus shown in FIG. 1, partially cut away.

The apparatus shown in the drawings is intended for transferring a continuous feed of filamentary material being wound on one drum or spool to another drum or spool when the first drum or spool has received its complement of filamentary material.

In the example to be described, the filamentary material referred to is wire, although it is clear that other strand material may also be so wound. This wire, indicated by reference numeral 1, is to be wound on to one or the other of two main spools 4 and 8 which are removably mounted on respective fixed rotatable shafts cantilevered from the support wall S of a suitable housing H and are parallel to one another.

Each spool 4, 8 is provided with a co-axial auxiliary spool 12 at one end such as seen in FIG. 2 and end or frontal flanges 17.

When one of these spools has received its complement of wire, normally when it is full, feed of wire is transferred by the present apparatus to the other spool.

The wire 1 is initially fed over one of two entry or feed rollers 2*a* and 2*b* and thence to respective ones of two pairs of guiding pulleys 3*a* and 3*b* which are mounted on traversing carriage 10 being carried by means of arms 11. In known manner, the arms 11 are movable parallel to the axes of the spools 4 and 8 as seen by arrow A in FIG. 2 and the pulleys 3*a* and 3*b* are rotatable by drive means located in the traversing carriage and/or housing in planes parallel to the planes in which the spools 4 and 8 are rotated so that wire is drawn on to the respective spools 4 and 8 from the pulleys and caused to traverse evenly along the length of the cores of the spools 4 and 8. Construction of the spool shafts, drive means, and feed means as thus far disclosed is conventional and will follow commonly used techniques.

Figure 1:
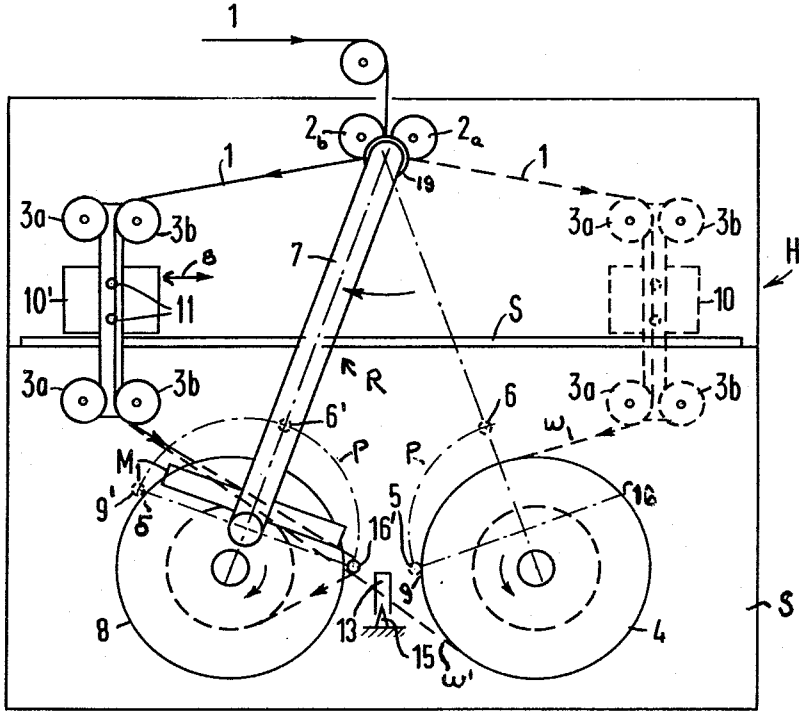
FIG. 1 is a diagrammatic view of the apparatus, for continuously winding filamentary material on to rotating spools according to the present invention.
Figure 3:
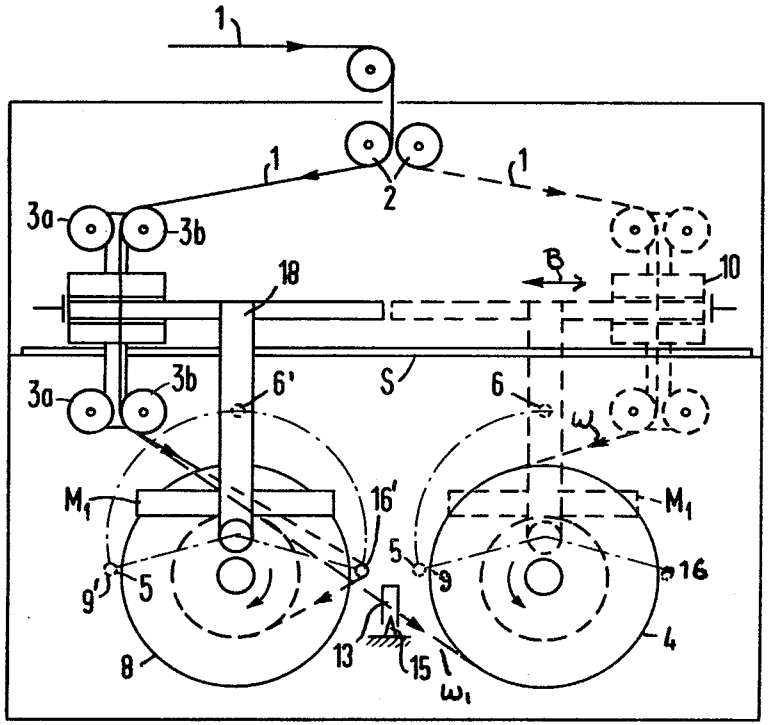
FIG. 3 is a view similar to FIG. 1 of a further embodiment for continuously winding filamentary material onto rotating spools according to the present invention.

The carriage 10 is also reciprocated at right angles (arrow B in FIG. 1) to the axes of the spools 4 and 8 between two positions, by movement along a shelf S, or suitable bracket mounted on the supporting wall, in one of which the pulleys 3*a* and 3*b* normally feed the spool 4 with wire (shown in broken lines in FIGS. 1 and 3)

and in the other of which the pulleys 3a and 3b normally feed the spool 8 with wire (shown in full lines in FIGS. 1 and 3).

To provide the changeover of feed of wire 1 from one spool to the other, the form of apparatus shown in FIGS. 1 and 2 includes a single transfer device R to serve both spools 4 and 8. The device R is arranged to be brought before the spool 4 or 8 which is to be wound before starting a changeover operation in the feed of the wire from the pulleys 3a and 3b and, for this purpose, is mounted eccentrically to the spool shafts and has parts which can swing in the manner of a pendulum. These parts include a supporting arm 7 depending at its upper end from a bearing 19 journalled above the plane of the spool axes and centrally therebetween. The arm 7 is connected via the shaft of the bearing 19 to a motor drive M2 which causes it to swing at a given signal. Supported, at its other end, are lower shift members to be described below, to shift the wire feed automatically from one spool to the other. The arm 7 hangs centrally between and above the spool shafts and can swing between two positions in each of which the arm extends radially of the axis of a respective spool 4.

The shift members supported at the lower end of the arm 7 include a pin or roller 5 extending parallel to the axes of the spools 4 and 8. The roller 5 is mounted at the end of a right angle crank C connected to a motor M1 which can turn the roller 5 about an axis X which is not its own axis through an arcuate path P as shown by the chain-dot lines in FIG. 1, passing from one end position 9, 9' through a mid position 6, 6' to assume a chordally opposite position 16, 16'. The roller is sufficiently long to axially overhang the auxiliary spool 12 and the adjacent flange 17 of the respective spool 4 or 8.

Supposing now that the wire 1 is being fed onto the spool 4. The wire passes over inlet roller 2a and feed rollers 3a taking path W shown in broken lines on the righthand side of FIG. 1. The carriage 10 reciprocates parallel to the axis of the rotating spool 4 as the wire is laid on the spool 4 between its flanges. The arm 7 is aligned radially with the spool 4 and the roller 5 is in its end position 9 which is nearest the empty spool 8.

When the spool 4 has received almost all its complement of wire, e.g., when it is almost full with wound wire, the roller 5 is pivoted by the motor M1 to the position 6 (midway between its end positions) so that it is raised above the auxiliary spool and the flange 17 of the spool 4. The arm 7 then is caused to swing over to the spool 8 to take up the position shown in full lines in FIG. 1. The roller 5, which is then in position 6', is subsequently pivoted back to its original end position shown at 9'. By this means, the roller has been lifted clear of the flanges 17 of the spools 8 and 12 when the arm 7 swings to the spool 8.

The carriage 10 is then moved along its linear path B at right angles to the axes of the spools towards the position associated with spool 8 (solid lines) so that the wire 1 transfers to the other rollers 3b of the respective pairs of rollers 3a and 3b and travels to the auxiliary spool 12 next to the empty spool 8, as is shown by path $W_1$, in broken lines in FIG. 1. The movement of the carriage 10 towards the spool 8 is coordinated with the movement of the arm 7 so that the wire 1 trails the roller 5. As this movement takes place, the carriage 10 is also moved parallel to the axes of the spools 4, 8 towards the auxiliary spools 12, the wire being maintained clear of the nearest flange 17 of the spool 8 so that, upon reaching the position 10', the wire travels close to the core of the auxiliary spool 12 of the spool 8.

In the meantime, the spool 8 and its auxiliary spool 12 is set into rotation and the wire 1 is urged, by means of a pressure-applying device 13 which can be an extensible piston rod actuated pneumatically, hydraulically or electromagnetically, into the path of a catcher blade 14 carried by the auxiliary spool 12. When the wire is caught, it is clamped by the blade 14 and cut off by a blade 15 to sever feed to the spool 4.

The fully wound spool 4 is then automatically braked and can then be replaced by an empty spool.

A required length of wire 1 is now wound on to the auxiliary spool 12 associated with spool 8 and then the roller 5 is lifted by the motor M1 from its end position 9' to its middle position 6'. It can be seen that this movement causes the roller 5 to engage and lift the wire 1 which begins to form a loop as it is being drawn on to the spool 12. At the same time, the carriage 10 retracts parallel to the axes of the spools towards the empty spool 8 and, accordingly, the wire 1 is lifted by the roller 5 over the adjacent flange 17 of the spool 8. The roller 5 then drops to its other end position 16' so that the wire, still initially trained around the roller 5 as the carriage 10 retracts, passes over the end of the spool 8.

Further excursion of the carriage 10 pulls the wire clear of the roller 5 so that the wire is drawn directly on to the core of the spool 8 from the rollers 3b. The carriage is then reciprocated between the flanges of the spool 8 as wire is being wound thereon until the spool 8 is filled.

The cycle is then repeated in reverse manner when the spool 8 is nearly full of wire so that wire feed is transferred to the replacement empty spool 4. Briefly, when this happens, the roller 5 is lifted from position 16' to position 6', the arm thereafter swings towards the spool 4, the carriage 10 moves towards the spool 4 with the wire trailing the roller 5 which reaches the position 6, and the roller 5 drops back to position 16, this time adjacent the auxiliary spool of the spool 4. The carriage 10 meanwhile has moved the rollers 3a and 3b over the auxiliary spool 12 of the spool 4, the wire being kept clear of the adjacent flange of the spool 4. The spool 4 is set into rotation, the device 13 urges the wire into the path of a snare or catcher blade 14 carried by the auxiliary spool of the spool 4, the wire is cut by the blade 15, and after a few rotations of the auxiliary spool, the roller 5 lifts to position between 6 and 9 to entrain the wire, which is then lifted over and on to the core of the spool 4. Finally, the roller 5 drops to its original position 9 ready to transfer wire again to the spool 8.

As shown, it is advantageous for the auxiliary spools 12 and/or the device R to be arranged on the withdrawal side of the spools 4 and 8.

Figure 4:
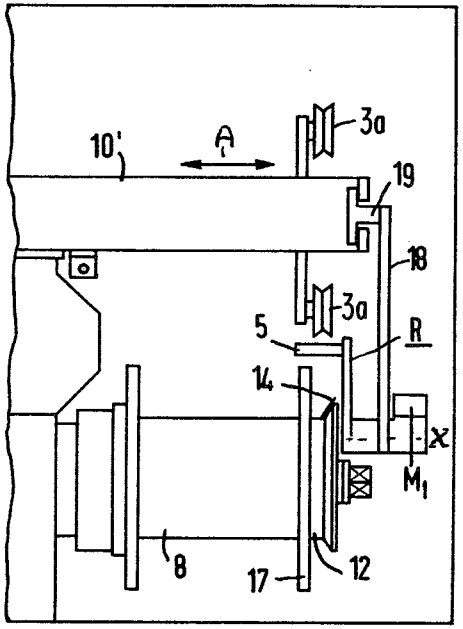
FIG. 4 is a side view similar to that of FIG. 2 of the apparatus shown in FIG. 3.

The operation of the form of apparatus shown in FIGS. 3 and 4 is basically similar and like parts have been given like reference numerals.

In contrast, however, to the pendulum-like movement of the arm 7 to provide wire feed changeover, the apparatus shown in FIGS. 3 and 4 includes a vertical, horizontally or substantially horizontally movable supporting arm 18. The arm 18 is guided for horizontal movement by means of a T-shaped member 19 which is slidable within an elongate recess of corresponding shape. In this case, therefore, the arm 18 moves at right angles or substantially at right angles to the spool axes along a straight lines. The final positions are radial to the center of the spools.

Figure 5:
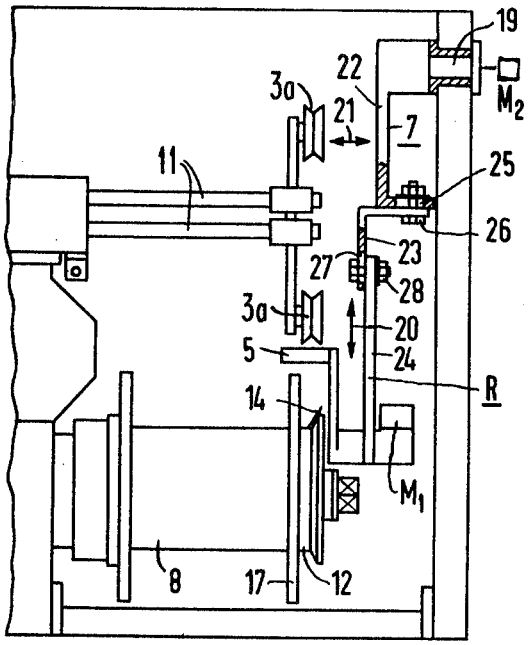
FIG. 5 is a view similar to FIGS. 2 and 4 of still a further modification to the apparatus of FIGS. 1 and 3.

FIG. 5 illustrates a modified device R for changing the feed of the wire from one spool to the other and is an adaptation of the device R shown in FIGS. 1 and 2. This modified form enables the apparatus to be used with spools of different overall length and, for this purpose, the device R and/or its supporting parts are displaceable in a direction parallel to the axes of the spools. Also, so that spools having different flange diameters can be accommodated, the device has means to move its parts clear of the flanges.

As illustrated, the supporting arm 7 (mounted in the manner of a pendulum) can be adjusted in the direction of the double arrow 20 to move the pin or roller 5 at right angles to the axes of the spools clear of their flanges. The component 23 of the arm 7 can also be adjusted parallel to the axes of the spools in the direction of the double arrow 21 to allow for spools of different lengths, in particular to allow for different winding lengths (different lengths of core).

This supporting arm 7 includes components 22, 23 and 24. The component 22 includes a cranked arm with a slot 25 in which a nut and bolt assembly 26 is slidably mounted to connect the components 22 and 23 of the arm together. This construction provides for movement of the component 23 relative to the component 22 in the direction of the arrow 21.

Similarly, a nut and bolt assembly 28 is slidably mounted in a slot 27 of the component 23 so that the component 24 can be moved in the direction of the arrow 20 relative to the component 23.

Before operation of the apparatus, it will be appreciated that the respective nut and bolt assemblies are tightened.

In addition to or instead of the means just described, it is possible to have a replaceable pin or roller 5 so that a pin or roller 5 of a longer or shorter length can replace the original pin or roller 5. Instead of this, the pin or roller 5 could be of a telescopic design.

It will be appreciated that the modifications illustrated in FIG. 5 and just described can be incorporated in the form of apparatus shown in FIGS. 3 and 4.

It will also be appreciated that the apparatus described above can be used for winding thin wire and, because of the provision of auxiliary spools, it is possible for the end of wire wound on a particular auxiliary spool to be of a desired length suitable for joining, e.g., by welding, this end to another wire end.

Various changes, modifications and embodiments have been suggested in the foregoing description, others will be obvious to those skilled in the art. It is intended, therefore, that the present disclosure be taken as illustrative only and not as limiting of the present invention.

What is claimed is:

1. Apparatus for continuously winding strand material onto spools comprising a pair of parallel spool shafts, a set of main and auxiliary spools removably mounted on each shaft for rotation about the axis thereof, pulley means for laying said strand onto said spools, said pulley means being movable in a direction parallel to the axes of said spool shafts to traverse the spools in each set, and in a direction perpendicular to the axes of said spool shafts to transfer the strand from one set of spools to the other, means operative upon transfer of said strand from one set of spools to sever said strand and attach said strand to the auxiliary spool of the other set, and excursion means movable in advance of the transfer of said strand, alternately between said sets of spools to form a loop of strand about said auxiliary spool, for subsequent traverse of said strand about said main spool after said strand is attached to said auxiliary spool.

2. The apparatus according to claim 1, wherein the excursion means includes roller means for engaging said strand arranged about an axis parallel to the axis of said spools and eccentric to the center thereof, said roller means being mounted on a carrying arm movable between said sets of spools.

3. The apparatus according to claim 2, wherein said carrying arm is pivotably mounted to swing as a pendulum between said sets of spools.

4. The apparatus according to claim 3, including motor means for swinging said arm.

5. The apparatus according to claim 2, wherein said arm is mounted to move linearly in a direction perpendicular to the spool shafts between said sets of spools.

6. The apparatus according to claim 5, including motor means for moving said carrying arm.

7. The apparatus according to claim 6, including track means, associated with said carrying arm mounted above said spool shafts and perpendicular to the axis thereof, said carrying arm having bearing means at its upper end located in said track so as to be movable therealong.

8. The apparatus according to claim 1, wherein said pulley means is mounted on a carriage, said apparatus including a surrounding frame, said carriage being mounted to reciprocate along the parallel and perpendicular direction to the spool axes, said pulley means being rotatable in planes perpendicular to the axis of rotation.

9. The apparatus according to claim 2, wherein said roller means is removably mounted to said carrying arm.

10. The apparatus according to claim 2, wherein said roller means is extendible parallel to the axis of said spool shaft.

11. The apparatus according to claim 1, wherein said excursion means is mounted relative to the axis of said spool shaft at the end from which said spools are removed.

* * * * *